United States Patent [19]

King et al.

[11] 4,353,054

[45] Oct. 5, 1982

[54] STOP SIGN WATCHER, A DEVICE FOR MONITORING VEHICLES AT FULL STOP SIGN INTERSECTIONS

[76] Inventors: Lawrence J. King; Irene T. King, both of 27 Cambridge Dr., Smithtown, L. I., N.Y. 11787

[21] Appl. No.: 63,839

[22] Filed: Aug. 6, 1979

Related U.S. Application Data

[63] Continuation-in-part of Ser. No. 773,471, Mar. 2, 1977, abandoned.

[51] Int. Cl.[3] ..... G08G 1/10

[52] U.S. Cl. ..... 340/31 C; 340/38 R; 346/107 VP

[58] Field of Search ..... 340/31 R, 31 C, 22, 340/38 R, 38 L, 38 S, 38 P; 346/33 D, 107 VP; 235/92 TC

[56] References Cited

U.S. PATENT DOCUMENTS

| | | | |
|---|---|---|---|
| 2,347,194 | 4/1944 | Holliday | 340/31 R |
| 2,927,837 | 3/1960 | Martin | 340/31 C |
| 3,544,958 | 12/1970 | Carey et al. | 340/31 R |
| 3,618,003 | 11/1971 | Marshall | 340/31 C |
| 3,689,878 | 9/1972 | Thieroff | 340/31 C |
| 3,714,642 | 1/1973 | Lavarenne | 340/31 C |
| 3,849,784 | 11/1974 | Holzapfel | 340/31 C |
| 3,858,223 | 12/1974 | Holzapfel | 340/31 C |

*Primary Examiner*—James J. Groody

[57] ABSTRACT

A STOP SIGN monitoring device; containing a counter, audible alarm and switching provisions for photographic equipment. An electrical pulse is generated whenever a vehicle fails to make a defined "FULL STOP" at roadway intersections where FULL STOP SIGNS are posted.

7 Claims, 1 Drawing Figure

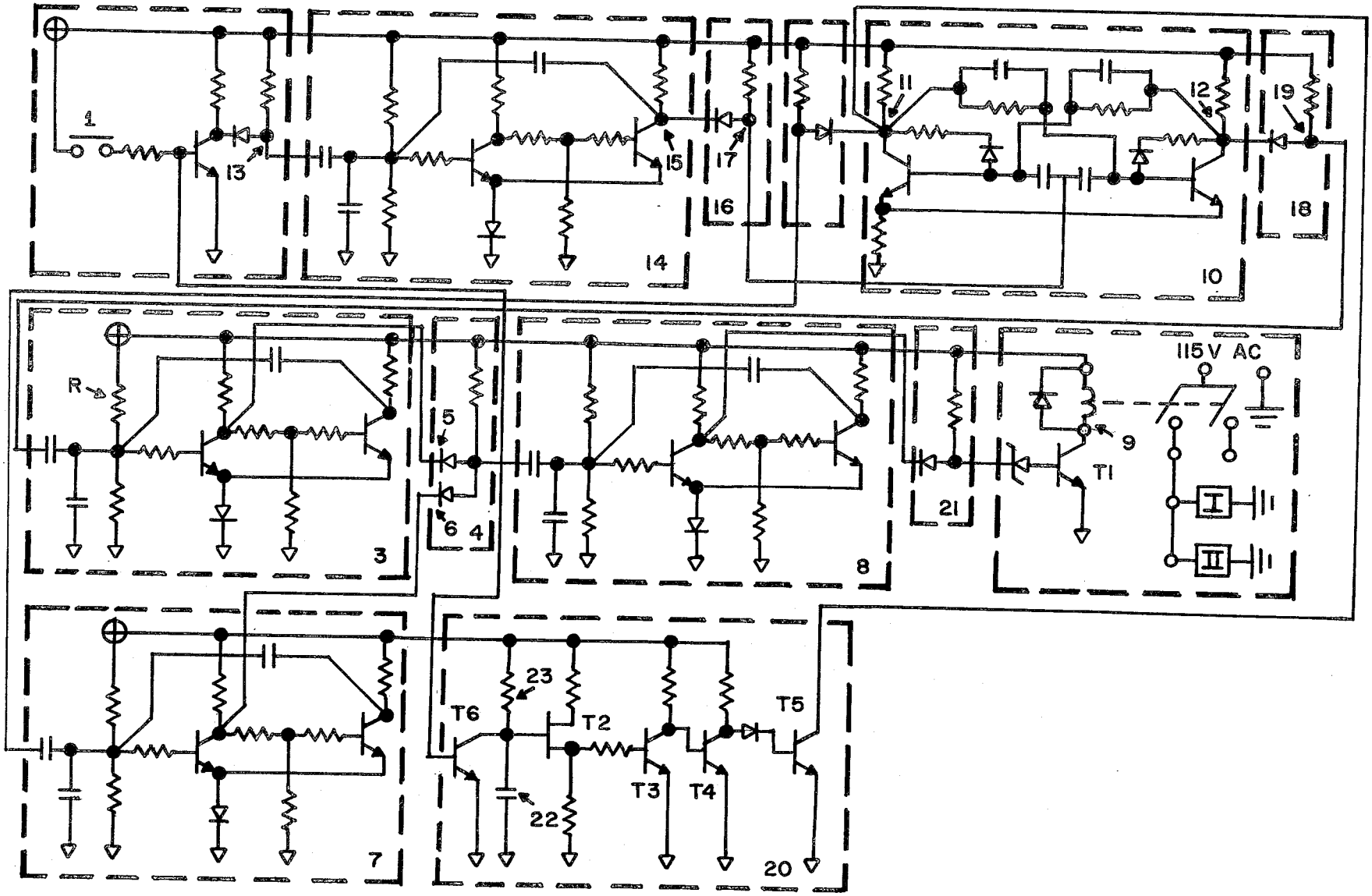
115 V AC
T1
T2
T3
T4
T5
T6
R

STOP SIGN WATCHER, A DEVICE FOR MONITORING VEHICLES AT FULL STOP SIGN INTERSECTIONS

This application is a continuation in part of Ser. No. 773,471, filed Mar. 2, 1977, now abandoned.

BRIEF SUMMARY OF THE INVENTION

The device is an assembly of electronics and electrical components performing to monitor those vehicles that fail to make a defined "FULL STOP" at FULL STOP SIGN intersections. The time period between the front and rear wheel passage over a pressure type road sensing switch coupled to a unique circuit design determines whether or not a non-stop signal is generated. The sensing switch is laid across the road surface positioned approximately 35 ft. before the Stop Sign. When the non-stop signal is generated, it is used to trigger a counter, audible alarm and furnish only control for photographing offending vehicles.

Simply stated, the invention entails an operation whereby the first pulse generated by the vehicles front wheels, is stretched in time to enable the first half of a two input and gate for the defined FULL STOP period. A second pulse generated by the vehicles rear wheels is used to enable the second half of the two input and gate. The arrival of the second pulse during the period of the first pulse AND GATE enablement, completes the AND GATE and effects an output gate signal indicating a NON-STOP.

The arrival of the second pulse after the first half disablement of the AND GATE, does not effect a gate signal since both inputs are not present simultaneously. This action indicates that the monitored vehicle has executed a defined FULL STOP.

The arrangement of the circuitry, shown in FIG. 1, is intended to generate an electrical pulse whenever the rear wheels of a monitored vehicle activate switch 1 within 2.5 second period has been selected to satisfy the definition for FULL STOP; however this period may be varied, within limits with different values of resistor RR.

Upon front wheel actuation of switch 1, monostable mutivibrator, 3, is triggered to its metastable state to satisfy one-input, point 5, of the main gate, 4 for 2.5 sec. A rear wheel activation of switch 1, anytime during this 2.5 seconds will satisfy the second input; point 6, to main gate 4 via the metastable state of monostable multivibrator, 7. The coincident presence of electrical signals at both inputs, 5 and 6, to gate 4 will effect an output pulse from gate 4, the duration of which is the metastable state of monostable multivibrator, 7, ie approx. ¼ sec. The output pulse from gate 4 triggers monostable multivibrator 8, whose metastable state now energizes relay 9 for a period necessary to count, provide switching control for photography and/or actuating a horn.

This cycle is indicative of a non-stop situation. Now conversely, if the rear wheels activate the sensor switch 1 after the metastable period of monostable multivibrator 3, AND GATE 4 will not be enabled; hence no non-stop signal will ensue from gate 4. This cycle is indicative of a defined FULL STOP.

DESCRIPTION OF THE DRAWING

The drawing is a schematic circuit line diagram showing the components and the configuration of circuitry which constitute the device.

DETAILED DESCRIPTION

To more fully present an understanding of FIG. 1, a detailed explanation follows:

It should be noted that the quiescent state of control FLIP-FLOP 10 must be configured where the output at 11 is low and the output at 12 is high prior to the beginning of each monitoring cycle:

The front wheel actuation of rod sensor switch 1 effects the fall of the voltage level at point 13. This action triggers monostable multivibrator, 14 whose function is to block any spurious spikes originating from the contact bounce of switch 1. It should be noted that monostable multivibrator, 14, does not contribute any delay to the signal from switch 1 since the output from monostable multivibrator 14 is taken from point, 15. The voltage at point 17 of gate 16 will fall effecting a change in state of FLIP-FLIP 10. Output 12 goes low and output 11 goes high.

The voltage descent at point 12 of FLIP-FLOP 10 drops the voltage at point 19 of gate 18 and in turn monostable multivibrator 3 is triggered into its metastable state. One-half of main gate 4, point 5 will be satisfied for 2.5 sec. Now assuming the rear wheels close road sensing switch 1 before the monostable multivibrator 3 reverts to its stable state, the following occurs: The same sequence of events is repeated whereby monostable multivibrator 14 is triggered to its metastable state and the subsequent voltage decent at point 17 of gate 16 causes FLIP-FLOP 10 to reset or revert to its defined quiescent state.

Output 11 goes low and control monostable multivibrator 7 is triggered to satisfy the remaining input, point 6 to main gate 4. GATE 4 is fully satisfied and the resulting "NON-STOP" output pulse indicates that the vehicle did not make a defined full stop. Monostable multivibrator 8 is triggered by the trailing edge of this pulse and the metastable state of 8 turns on transister T1, via gate 21. Relay coil 9 is energized and the two normally open contacts close for counting, alarming, and furnishing only control for photographing offending vehicles. I is representative of a counter, II is an alarm means controlled by 1 set of normally open contacts. They are connected from 1 set of normally open contacts. The remaining contact is for control only of photographic operations.

For the case where the rear wheels activate the road sensing switch 1 after monostable multivibrator 3 has returned to its stable state, the following occurs: Monostable multivibrator 7 is triggered by previously described events to furnish one input to main gate 4. It should be noted that the remaining half of GATE 4 has been disabled by monostable multivibrator 3's return to its stable state. In the absence of both inputs simultaneously, gate 4 will not issue a non-stop pulse to actuate relay 9 via monostable multivibrator 8. This action indicates that the monitored vehicle has executed a defined "FULL-STOP".

The circuitry, identified as 20, is an auxiliary grouping of components whose function is to generate an electrical pulse approximately once every three minutes to insure the correct setting of FLIP-FLOP 10. At the beginning of each cycle, i.e. for each front wheel activation, it is a requirement that the quiescent state of FLIP-FLOP 10 reflect a configuration where output 12 is high and output 11 is low; later in the text referred to as the first and second outputs respectively. An incorrect setting of FLIP-FLOP 10, by whatever means would produce false indications. A correct setting of Flip Flop 10 can also produce a false Non Stop indication if a pulse from 20 is delivered within 2.5 sec. following front wheel actuation; however, this occurrance is precluded by pulsing transistor T6 by each front and rear wheel actuation. The turning on of transistor T6 removes the accumulated charge on capacitor 22, thereby delaying the next pulse from 20 to FLIP-FLOP 10 for approximately three minutes after each front and rear wheel actuation.

An explanation of the circuitry designated as 20 follows: A variable resistor-capacitor, timing circuit is utilized to generate the necessary period of pulsing. The capacitor at 22 charges through the resistor, 23, to a voltage level that triggers unijunction transistor, T2. T2 issues a positive pulse which initiates the following actions: T3 turns on, T4 turns off and T5 is turned on. The turning on of T5 brings ground to point 11 of FLIP-FLOP 10. If point 11 is high, the presence of ground via T5 turn on will effect a change in state of FLIP-FLOP 10. Point 11 goes low and point 12 goes high. This is the required configuration before each front wheel activation. However, on the other hand, if point 11 was already low, the appearance of a ground pulse at point 11 will not cause any change of state in FLIP-FLOP 10. Transistor T6 is pulsed on momentarily by each front and rear wheel actuation thus causing the timing cycle of R23, C22 to begin from zero time. This feature prevents the issuance of a resetting signal to FLIP-FLOP 10 for approximately three minutes, thus negating the possibility of generating a false non-stop signal, as a consequence of circuit 20 issuing a pulse within 2.5 seconds after front wheel actuation.

We claim:

1. A ground based detection device, capable of generating an electrical pulse whenever a monitored vehicle fails to essentially make a "Full Stop" at roadway intersections where "Full Stop" signs are posted; said ground based device comprising means for counting the offending vehicles, audible alarm means actuable in response to the offending vehicle, and control means for controlling the operation of photographic equipment for taking a picture of the offending vehicle, said ground based device further comprising: a source of electrical energy for the operation of the device, a single sensor means laid across a single lane for detecting the passage of the front and rear wheels of the monitored vehicle and producing a first and second output pulse respectively, a first monostable multivibrator switching means triggered by either said first or second output pulse of said sensor means and utilized for blocking contact bounce or false signals originating from said sensor means, five single input gates, the first and second of which serve as interface inputs to said first monostable multivibrator switching means and a single bistable switching means respectively, the third and fourth input gates serving as interface inputs to a second and third monostable multivibrator switching means respectively the fifth single input gate serving as an interface input to an output switching relay means, said second input gate coupled to the output of said first monostable switching means;

said single bistable switching means controlled directly by said first monostable switching means through said second single input gate; said third and fourth single input gates coupled to the inputs of said second and third monostable switching means respectively, first and second output of said bistable switching means controlling the triggering of said second and third monostable switching means respectively, via said third and fourth input gates, said second monostable switching means triggered by said first output of said single bistable switching means via said third input gate whenever said first output pulse of said sensor means is produced in response to the vehicle front wheel passage over said sensor means, a two input AND gate having one input coupled to the output or metastable state of said second monostable switching means; the time period of said metastable state of said second monostable switching means having limits which established a partial gate enablement time and constitutes a Full Stop Period, this period being adjusted by variable resistance in said second monostable switching means, said third monostable switching means triggered by said second output of said bistable switching means via said fourth input gate whenever the said second output pulse of said sensor means is produced in response to the vehicle rear wheel passage over said sensor means, the output or metastable state of said third monostable switching means having a period less than the period of the metastable state of said second monostable switching means, said output of said third monostable switching means being coupled to the other input of said AND gate, said two input AND gate being controlled by said second and third monostable switching means, the period of the AND gate output being determined by the period of the metastable state of said third monostable switching means, a fourth monostable switching means triggered by the output of said AND gate; an output of said fourth monostable switching means controlling the operation of said output relay means via said fifth input gate, said output relay means controlling said counter means, alarm means, and photographic control means, an independent time controlled pulse generator means controlling the quiescent state of said single bistable switching means.

2. A detection device as claimed in claim 1 in which the said first, second, third, and fourth monostable multivibrators switching means are accomplished by the classic solid state monostable multivibrators utilizing one output from each, and whose metastable state is of difference time durations.

3. A detection device as claimed in claim 1 wherein the said first monostable multivibrator switching means is utilized to block any switch bounce signals originating from the spring action between the tires and said sensor means.

4. A detection device as claimed as in claim 1 wherein the said pulse generator means whose period is independently controlled, comprises control for the preclusion of false non-stop signals and a junction transistor triggered at intervals by a RC Circuit, the transistor trigger output pulse being amplified, inverted and used to effect the quiescent state of said bistable switching means before the start of each detection.

5. A detection device as claimed in claim 1 in which the said output relay operated switching means comprises an operating coil with electromagnetic suppression and two normally open contacts.

6. A switching means as claimed in claim 5 wherein said electromagnetic suppression is accomplished by a diode connected across said operating coil: said operating coil controlled by a transistor switch which is controlled by the metastable state of said fourth monostable switching means.

7. In conjunction with the detection device as claimed in claim 5, said counting and alarm means to be energized in parallel connection by one of the said normally open contacts of said relay switching means: the remaining normally open contact furnishing only control for photographic equipment.

* * * * *